US011472052B2

(12) United States Patent
Lin et al.

(10) Patent No.: US 11,472,052 B2
(45) Date of Patent: Oct. 18, 2022

(54) RAZOR AND RAZOR HANDLE WITH ROTATIONAL PORTION

(71) Applicant: Edgewell Personal Care Brands, LLC, Chesterfield, MO (US)

(72) Inventors: Yi Jun Lin, Guangzhou (CN); Gregg Micinilio, Milford, CT (US); Thorsten Reich, Solingen (DE)

(73) Assignee: EDGEWELL PERSONAL CARE BRANDS, LLC, Chesterfield, MO (US)

( * ) Notice: Subject to any disclaimer, the term of this patent is extended or adjusted under 35 U.S.C. 154(b) by 907 days.

(21) Appl. No.: 16/326,815

(22) PCT Filed: Aug. 22, 2017

(86) PCT No.: PCT/US2017/047913
§ 371 (c)(1),
(2) Date: Feb. 20, 2019

(87) PCT Pub. No.: WO2018/039168
PCT Pub. Date: Mar. 1, 2018

(65) Prior Publication Data

US 2021/0308889 A1 Oct. 7, 2021

Related U.S. Application Data

(60) Provisional application No. 62/378,919, filed on Aug. 24, 2016.

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
CPC ..... B26B 21/521; B26B 21/225; B26B 21/52; B26B 21/22
(Continued)

(56) References Cited

U.S. PATENT DOCUMENTS 1,933,186 A 10/1933 Ryley
2,744,318 A * 5/1956 Borden ..... B26B 21/24 30/40.2
(Continued)

FOREIGN PATENT DOCUMENTS

JP 2003-093767 A 4/2003
JP 2011005041 1/2011

OTHER PUBLICATIONS

Unofficial translation of Japanese Office Action issued in connection with Japanese Patent Application No. 2019-510789 dated Jun. 17, 2021.
(Continued)

*Primary Examiner* — Nhat Chieu Q Do

(57) ABSTRACT

A razor handle for mounting a razor cartridge having at least one razor blade, which cartridge is pivotable about a cartridge pivot axis, is provided. The razor handle includes a grip portion, a cartridge mount portion, at least one biasing element, and a lock mechanism. The cartridge mount portion is pivotally attached to the grip portion and is rotatable about a cartridge mount pivot axis. The cartridge mount pivot axis is substantially parallel to the cartridge pivot axis. The at least one biasing element is configured to apply a biasing force against the cartridge mount portion that biases the cartridge mount portion in the normal first position. The lock mechanism is selectively translatable between a lock position and at least one unlocked position.

17 Claims, 9 Drawing Sheets

(58) Field of Classification Search
USPC ..... 30/527
See application file for complete search history.

(56) References Cited

U.S. PATENT DOCUMENTS 4,797,998 A 1/1989 Motta
4,879,811 A * 11/1989 Cooney ..... B26B 21/52 30/527
4,922,609 A 5/1990 Grange
4,926,553 A 5/1990 Miskin et al.
5,167,069 A * 12/1992 Quinn ..... B26B 21/523 D28/48
6,189,222 B1 2/2001 Doyle
6,223,442 B1 5/2001 Pina
7,200,942 B2 4/2007 Richard
7,856,725 B2 12/2010 Marut
8,474,144 B2 6/2013 Royle
8,671,577 B2 3/2014 Brown
8,745,883 B2 6/2014 Murgida et al.
9,144,912 B2 * 9/2015 Marut ..... B26B 19/06
2007/0062043 A1 * 3/2007 Marut ..... B26B 21/523 30/50
2011/0252646 A1 * 10/2011 Gordon ..... B26B 21/225 30/47
2015/0266191 A1 9/2015 Maimone et al.
2016/0001455 A1 1/2016 Swenson
2016/0031102 A1 * 2/2016 Sacks ..... B25G 1/04 16/427
2016/0023636 A1 8/2016 Robertson et al.

OTHER PUBLICATIONS

"English language Abstract of JP2011005041A, retrieved from Espacenet."
"International Search Report of corresponding application PCT/US2017/047913."

* cited by examiner

RAZOR AND RAZOR HANDLE WITH ROTATIONAL PORTION

BACKGROUND OF THE INVENTION

1. Field of the Invention

The present invention relates to shaving razors in general, and to shaving razors having a handle with a rotatable portion in particular.

2. Background Information

Many prior art shaving razors have a rigid handle with a razor cartridge mounted to one distal end. In some embodiments, the razor may be a disposable unit wherein the razor cartridge cannot be replaced, and the entire razor is disposed of once the razor cartridge portion can no longer provide an acceptable shave. In other embodiments, the razor may include a disposable blade cartridge that can be removed and replaced once the blade cartridge portion can no longer provide an acceptable shave. In some embodiments, the blade cartridge may itself alone rotate relative to the handle about a widthwise extending axis that is substantially parallel to the blade(s) (i.e., the blade edge(s)) and substantially perpendicular to a lengthwise extending axis that extends along or is parallel to the length of the handle. The pivotal movement of the blade cartridge about the widthwise axis allows for some degree of conformance with the skin; i.e., the blade cartridge is enabled to follow the contours of the user's skin during shaving. The rigid handle in these type arrangements transfers a normal force applied by the user to the blade cartridge and ultimately to the skin surface being shaved. If during the shaving process the user applies too much normal force, the blades within the blade cartridge may excessively engage the skin surface and create skin irritation. On the other hand, if the user applies too little normal force, the blades within the razor cartridge may not engage the skin surface adequately, resulting in a less than desirable shave.

Thus, there is a need for a razor that can help the user apply a desirable amount of normal force that results is a safe, desirable shave that does not create skin irritation.

SUMMARY OF THE INVENTION

According to an aspect of the present disclosure, a razor handle for mounting a razor cartridge having at least one razor blade with a blade edge extending substantially along an edge line is provided. The razor handle includes a grip portion, a cartridge mount portion, at least one biasing element, and a lock mechanism. The grip portion extends along a lengthwise extending axis. The cartridge mount portion is pivotally attached to the grip portion and is rotatable about a pivot axis between a normal first position and a second position. The pivot axis is substantially parallel to the edge line. The at least one biasing element is configured to apply a biasing force against the cartridge mount portion that biases the cartridge mount portion in the normal first position. The lock mechanism is selectively translatable between a lock position wherein the cartridge mount portion is prevented from rotating relative to the grip portion from the first position and at least one unlocked position wherein the cartridge mount portion is free to rotate relative to the grip portion.

According to another aspect of the present disclosure, a razor is provided that includes a razor cartridge and a razor handle as described herein.

DETAILED DESCRIPTION OF THE PREFERRED EMBODIMENTS

Figure 1:
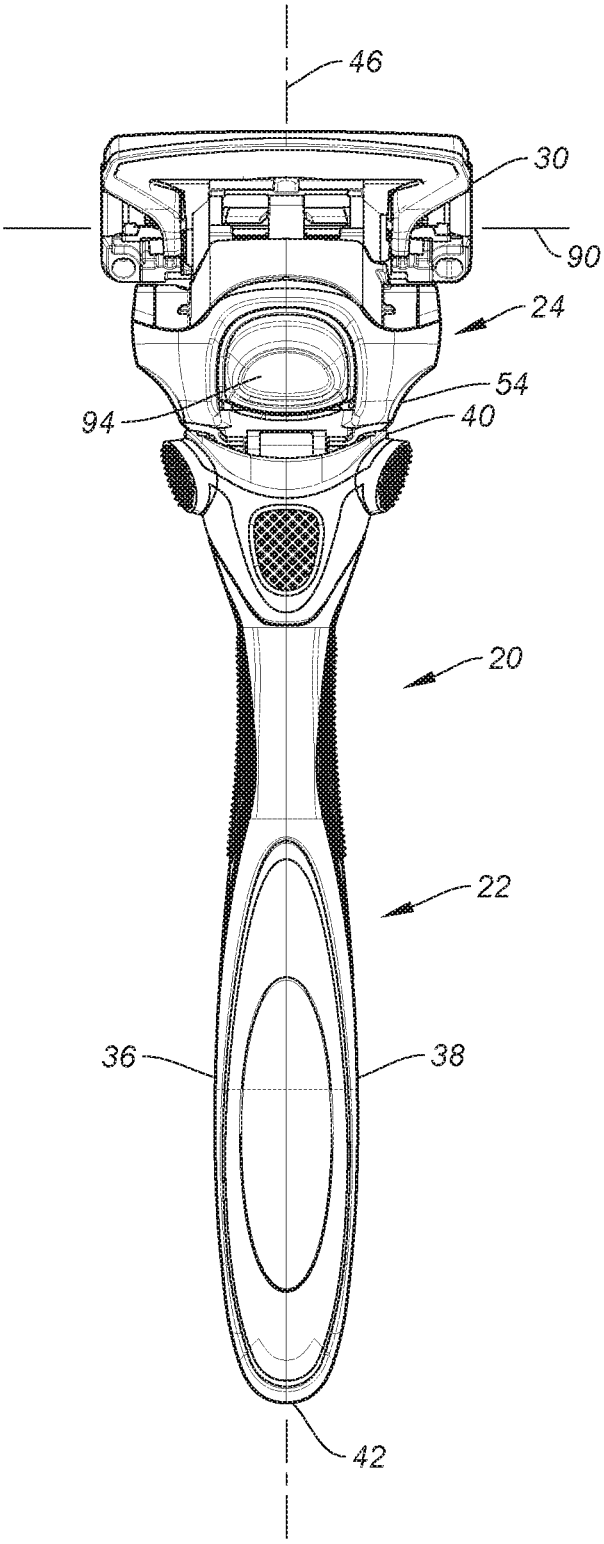
FIG. 1 is a top view of a razor handle embodiment.
Figure 2:
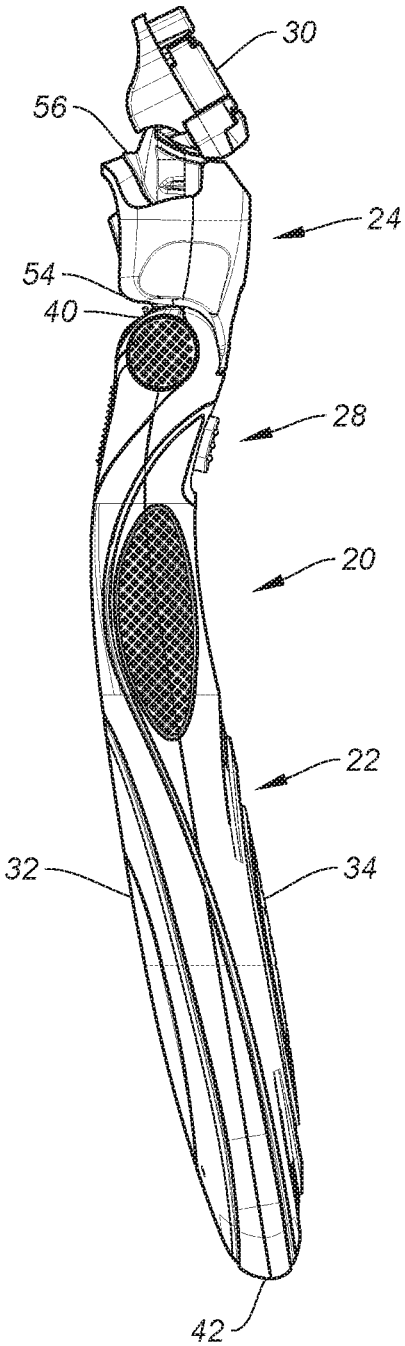
FIG. 2 is a side view of the razor handle embodiment shown in FIG. 1.
Figure 3:
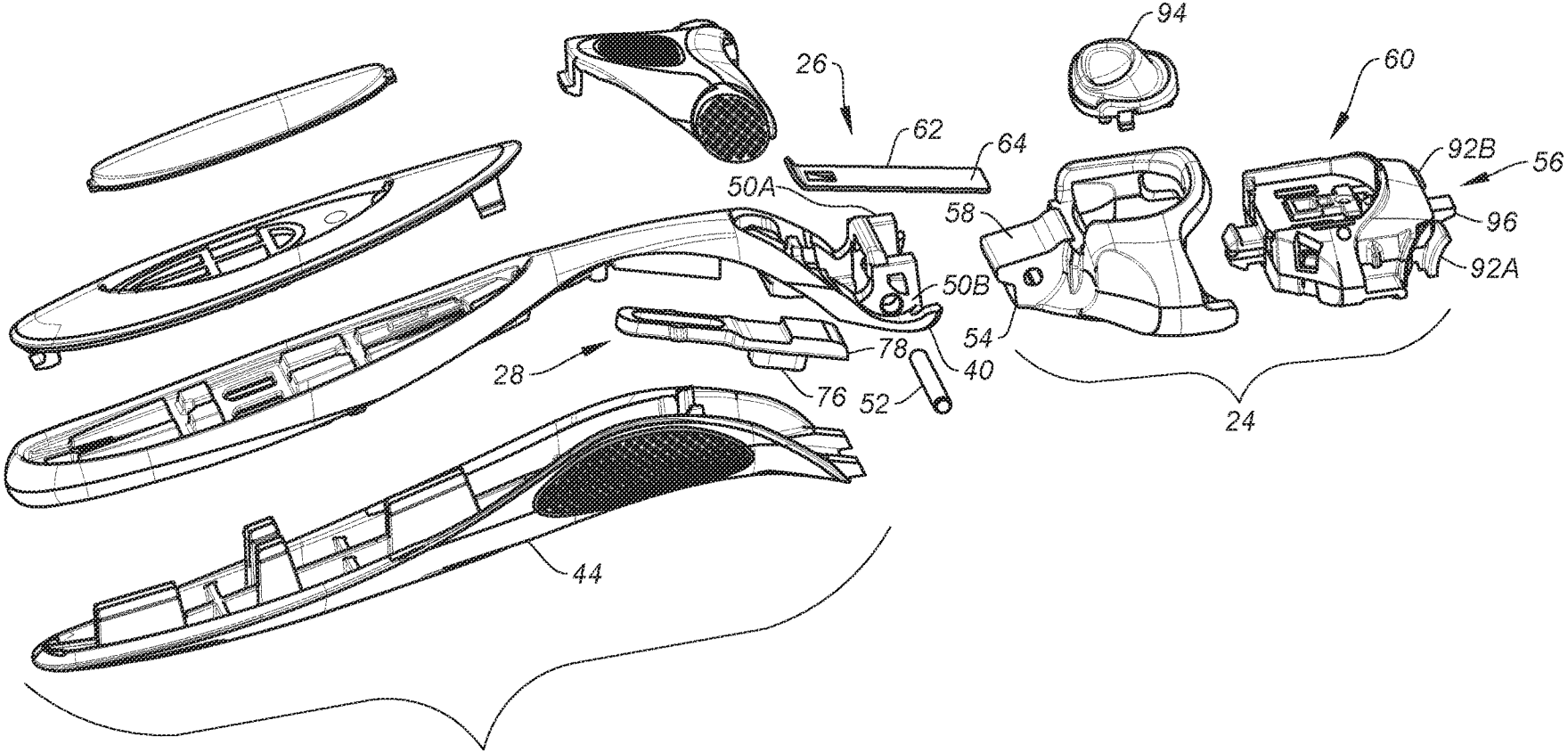
FIG. 3 is an exploded view of the razor handle embodiment.
Figure 4:
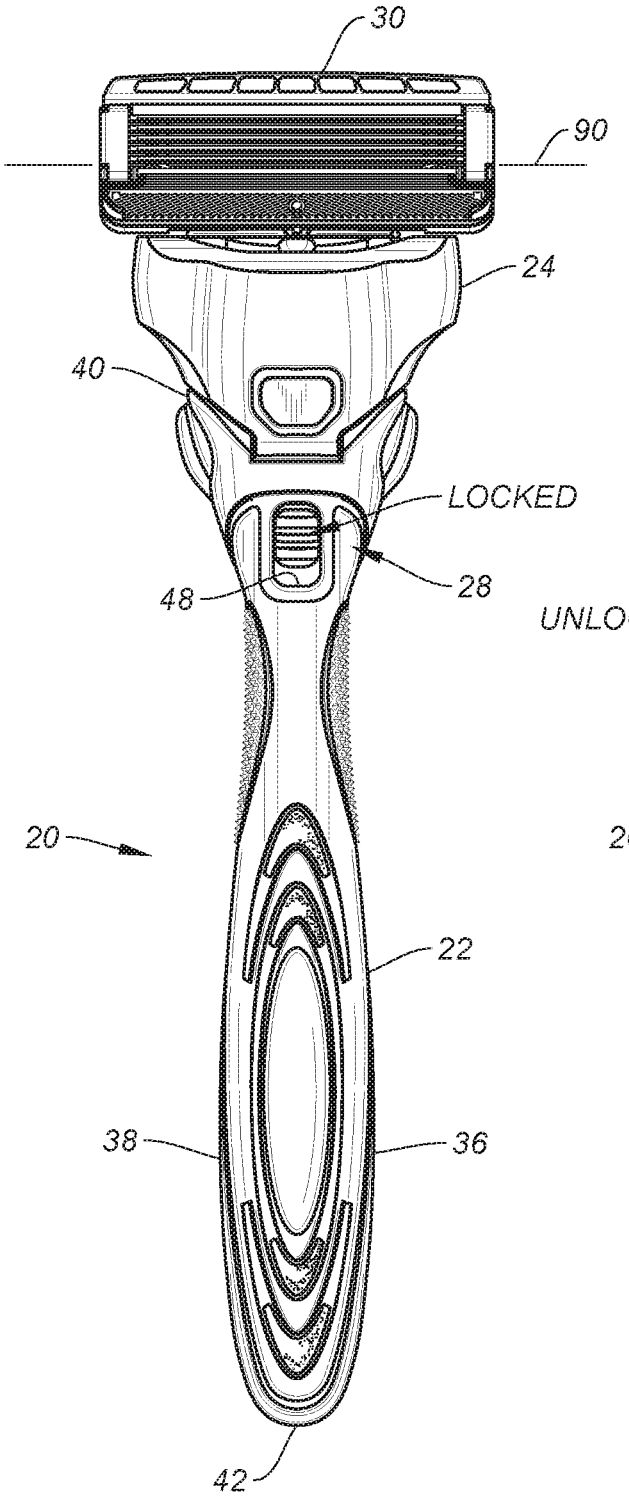
FIG. 4 is a bottom view of the razor handle embodiment shown in FIG. 1, showing the lock mechanism in a locked position.
Figure 5:
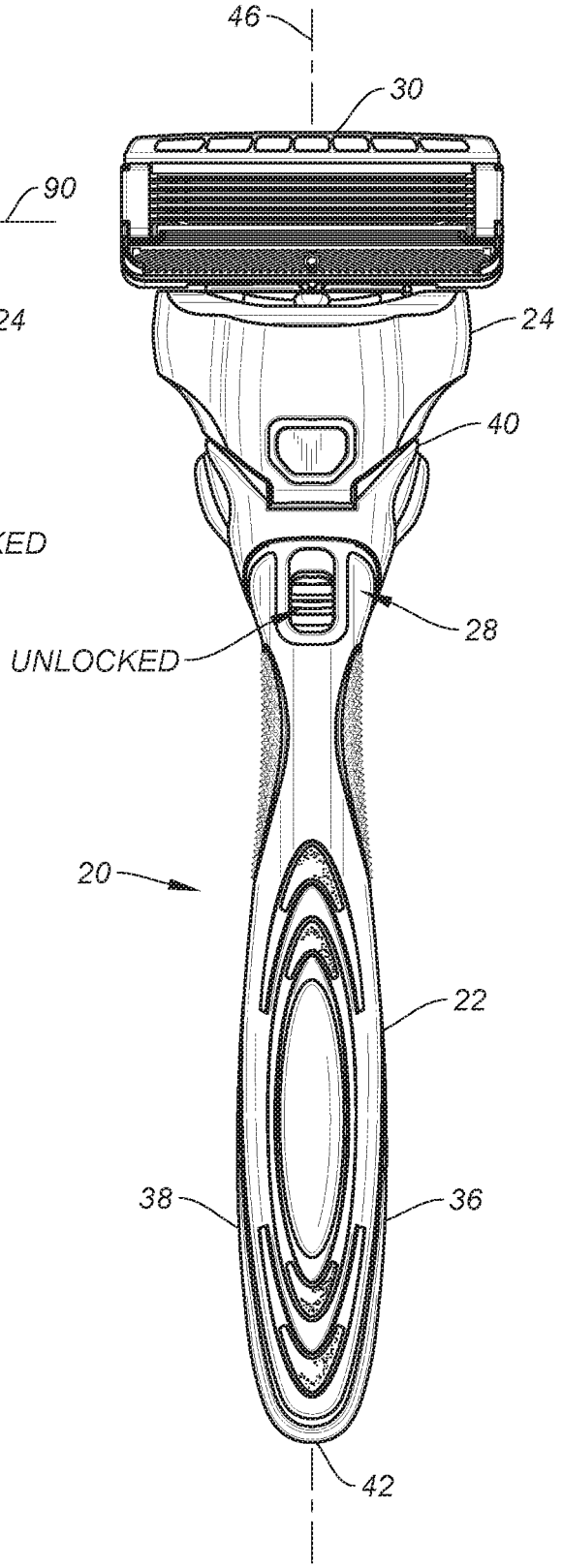
FIG. 5 is a bottom view of the razor handle embodiment shown in FIG. 1, showing the lock mechanism in an unlocked position.
Figure 6:
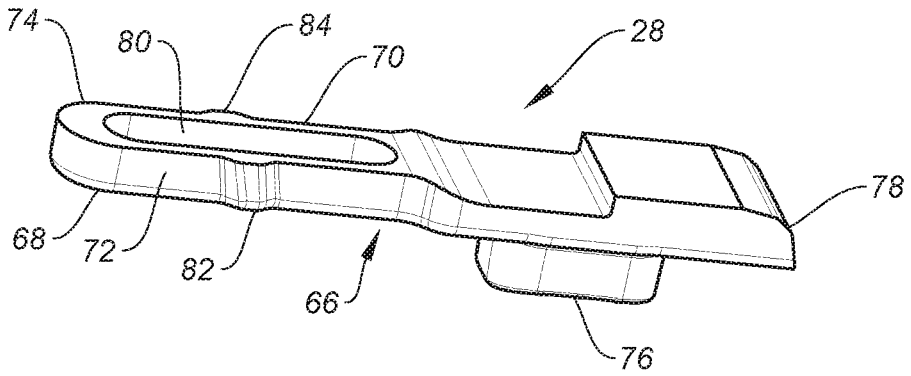
FIG. 6 is a perspective view of the lock mechanism embodiment.

Referring to FIGS. 1-5, a razor handle 20 is provided having a grip portion 22, a cartridge mount portion 24, at least one biasing element 26, and a lock mechanism 28. FIGS. 1, 2, and 4-7 show a razor cartridge 30 attached to the present razor handle 20. The cartridge mount portion 24 is pivotally attached to the grip portion 22. As will be described below, the cartridge mount portion 24 is configured to allow a razor cartridge 30 to be attached thereto. To facilitate the description herein, the razor handle 20 is described as having a top side 32, a bottom side 34 opposite the top side 32, a first lateral side 36, and a second lateral side 38. The first and second lateral sides 36, 38 are opposite one another and both extend between the top and bottom sides 32, 34. The razor cartridge 30 includes one or more razor blades that are located aft of a leading surface and forward of a trailing surface. The terms "aft" and "forward" as used herein indicate relative positions of elements; e.g., an element that is "aft" of a razor blade will encounter a particular point on a user's skin surface before the razor blade when the cartridge is translated in its normal cutting direction, and an element that is "forward" of a razor blade will encounter a particular point on a user's skin surface after the razor blade when the cartridge is translated in its normal cutting direction. Typically, a guard is mounted to or integral with the leading surface to stretch the skin as the razor cartridge 30 is moved over the user's skin, which causes the hairs to stand substantially erect in preparation for cutting. A cap is also typically mounted to or integral with the trailing surface. The skin-engaging surfaces of the guard and the cap and cutting edges of the razor blades are generally substantially aligned to define a shave plane. U.S. Pat. Nos. 7,658,009; 7,574,809; and 6,935,032, all of which are hereby incorporated by reference in their entirety, provide examples of how a shave plane may be defined.

The grip portion 22 may assume a variety of different configurations and is therefore not limited to any particular configuration. The non-limiting embodiment of a grip portion 22 shown in FIGS. 1-5 includes a mount end 40 and a distal end 42. As will be described in more detail below, the cartridge mount portion 24 is pivotally attached to the mount end 40 of the grip portion 22. In the embodiment shown in the exploded view of FIG. 3, the grip portion 22 includes a bottom panel element 44 and other elements that collectively create a unitary grip portion 22. Some of the elements are configured to create an ergonomically shaped handle 20 that can be easily gripped. In alternative embodiments, the grip portion 22 may comprise more or less (e.g., one) elements that create the unitary grip portion 22. The handle 20 (and therefore the grip portion 22) may be described as extending along a lengthwise axis 46 (e.g., see FIG. 1) that is generally centered between the lateral sides of the grip portion 22 of the handle 20.

Figure 7A:
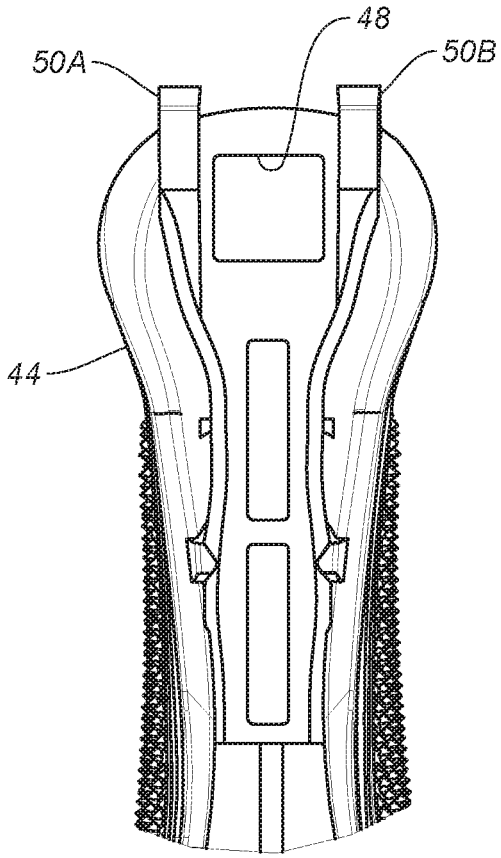
FIG. 7A is a partial view of a grip portion.
Figure 7B:
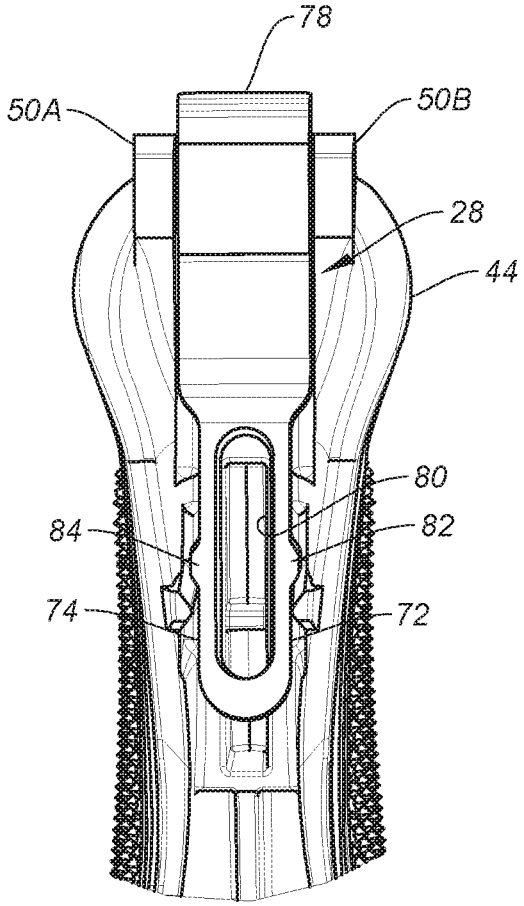
FIG. 7B is a partial view of the grip portion shown in FIG. 7A, including the lock mechanism disposed in the grip portion.
Figure 7C:
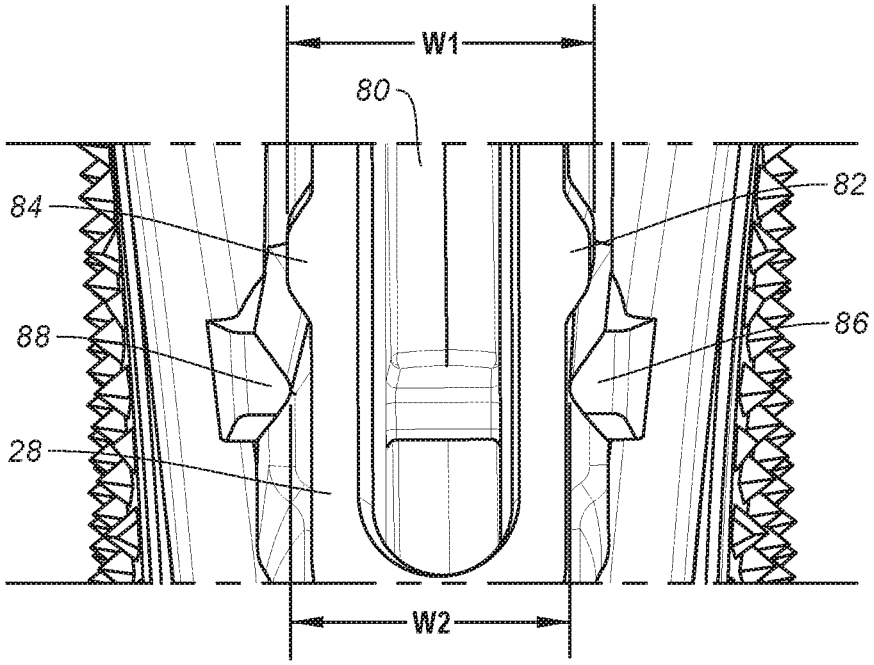
FIG. 7C is an enlarged partial view of FIG. 7B.

Now referring to FIG. 7A, in some embodiments the bottom panel element 44 may include an aperture 48 for receiving a lock button, and one or more detent features that cooperate with the lock mechanism 28 as will be described below.

Figure 16:
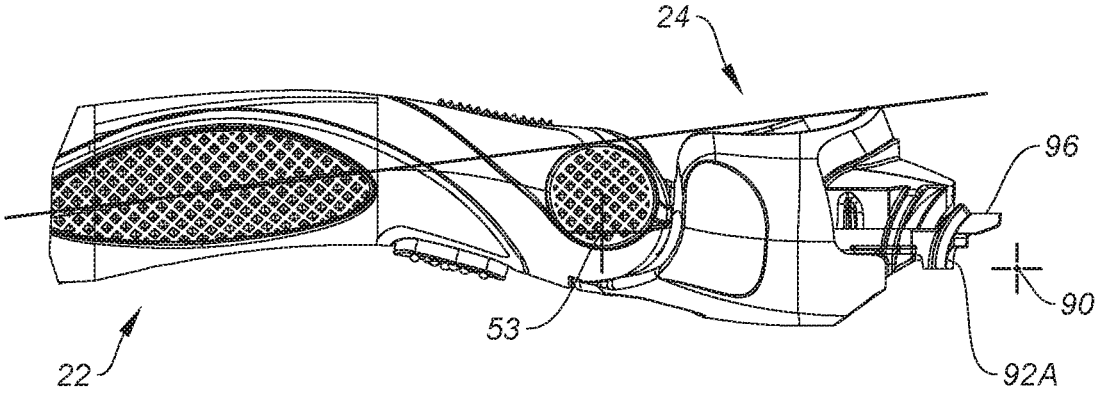
FIG. 16 is a detailed side view of the razor handle embodiment.

As indicated above, the cartridge mount portion 24 and the grip portion 22 are pivotally mounted to one another. The pivotal mounting can be accomplished in a variety of different ways. In the non-limiting embodiment shown in FIGS. 8 and 9, the grip portion 22 includes a pair of flanges 50A, 50B spaced apart from one another and located proximate the mount end 40, each with an aperture for receiving a pivot axle 52. The pivot axle 52 is rotatable about a pivot axis hereinafter referred to as the cartridge mount portion pivot axis 53 (see also FIG. 16).

Figure 8:
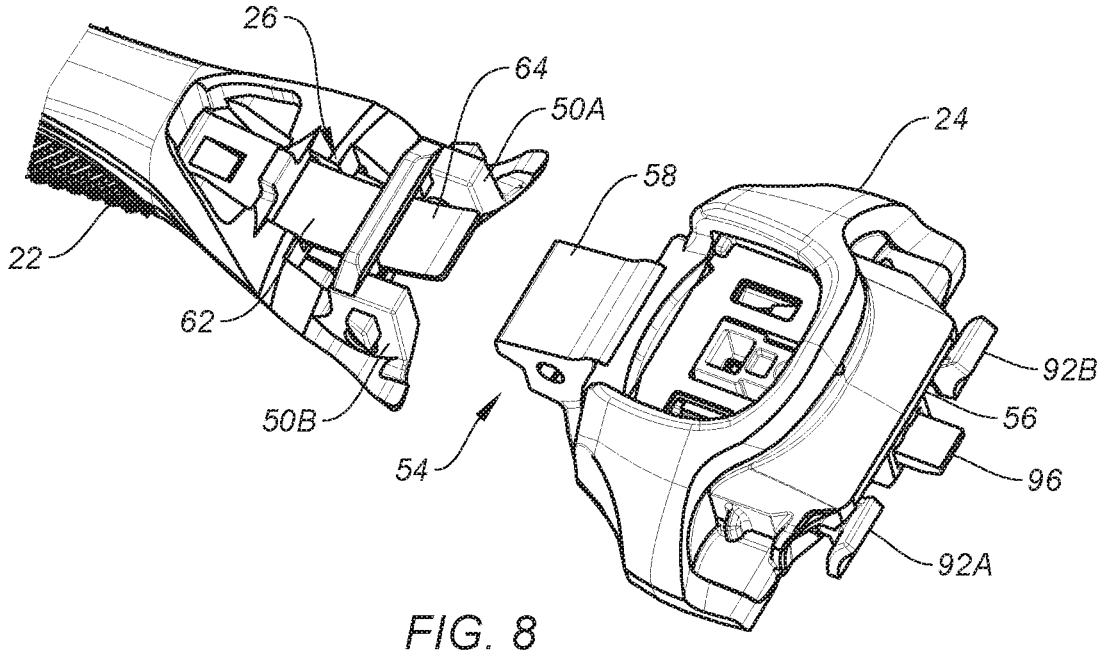
FIG. 8 is an exploded partial view of the razor handle embodiment, with the grip portion and cartridge mount portion separated.
Figure 9:
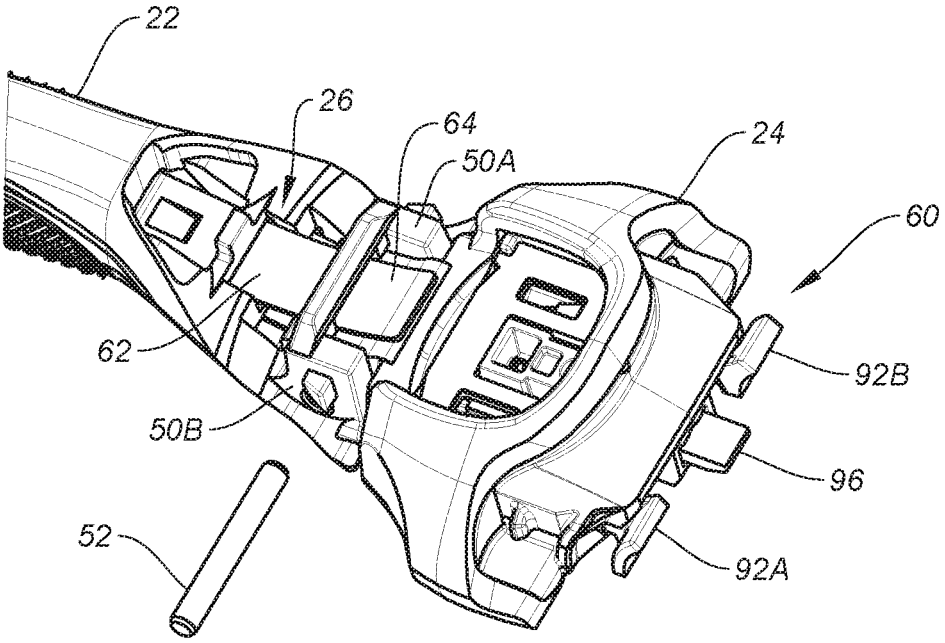
FIG. 9 is an exploded partial view of the razor handle embodiment, with the grip portion and cartridge mount portion attached to one another.

The cartridge mount portion 24 has a mount end 54, a cartridge end 56, at least one flange 58, and a cartridge attachment mechanism 60. In the embodiment shown in FIGS. 8 and 9, the at least one flange 58 is a single flange that is configured to fit between the pair of flanges 50A, 50B attached to the grip portion 22. The cartridge mount flange 58 has an aperture for receiving the pivot axle 52. Hence, in an assembled configuration the cartridge mount portion flange 58 is disposed between the grip portion flanges 50A, 50B and the respective apertures are aligned and receive the pivot axle 52. The described flange and pivot axle arrangement shown in FIGS. 8 and 9 is a non-limiting embodiment; e.g., the male and female arrangement of flanges can be switched so the grip portion 22 has a single flange that fits between a pair of flanges attached to the cartridge mount portion 24.

The mount ends 40, 54 of the grip portion 22 and the cartridge mount portion 24 may be configured to limit the amount of pivotal motion between the grip portion 22 and the cartridge mount portion 24. FIGS. 10-14 illustrate the range of pivotal motion up to an angle "α". The present disclosure is not limited to any particular amount (i.e., angle "α") of pivotal motion. An example of an acceptable range of the pivotal angle "α" is between ten and twenty degrees (10-20°). In a preferred embodiment, the maximum rotational motion (i.e., angle "α") is about fifteen degrees (15°).

Figure 10:
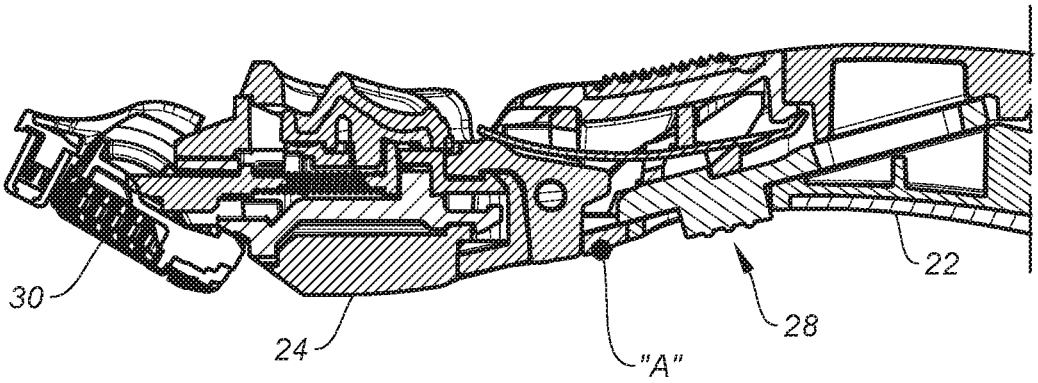
FIG. 10 is a side sectional view of the razor handle embodiment, showing the razor cartridge in a normal position.
Figure 11:
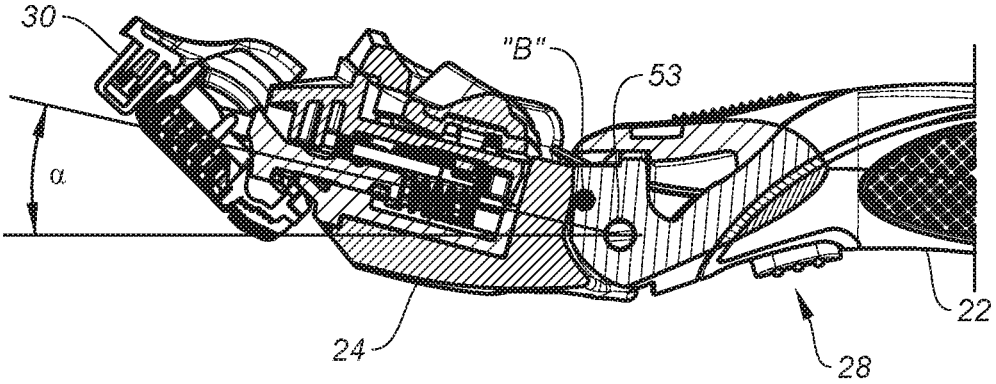
FIG. 11 is a side sectional view of the razor handle embodiment, showing the razor cartridge in a second position.
Figure 12:
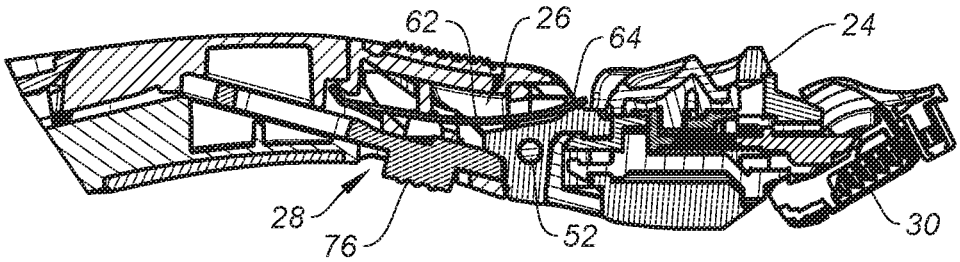
FIG. 12 is a side sectional view of the razor handle embodiment, showing the lock mechanism in a lock position and the cartridge mount portion in a normal at rest position.

The range of relative pivotal motion (i.e., angle "α") between the grip portion 22 and the cartridge mount portion 24 may be defined by physical stops at each end of the range; i.e., physical stops that prevent relative rotation beyond certain points. For example, in the embodiment shown in FIG. 10, at least one surface of the cartridge mount portion 24 contacts at least one surface on the grip portion 22 (shown at point "A") when the razor handle 20 is disposed in its normal at rest position and thereby prevents further relative motion (e.g., counterclockwise rotation in the orientation shown in FIG. 10) between the grip portion 22 and the cartridge mount portion 24. Similarly, as can be seen in FIG. 11, when the razor handle 20 is disposed in the maximum second position at least one surface of the cartridge mount portion 24 contacts a respective surface on the grip portion 22 (shown at point "B") to physically prevent further relative rotation (e.g., clockwise rotation in the orientation shown in FIG. 11). It should be noted that the cross-sectional views shown in FIGS. 10 and 11 are taken at a different widthwise positions to facilitate the above description. An advantage of the pivotal arrangement between the grip portion 22 and the cartridge mount portion 24 is that the pivotal structure is enclosed and does not include any feature that rotates out of the handle 20. The enclosed pivotal arrangement resists fouling from shaving debris and cannot be impeded by where the user places his or her digits on the grip portion 22.

Figure 14:
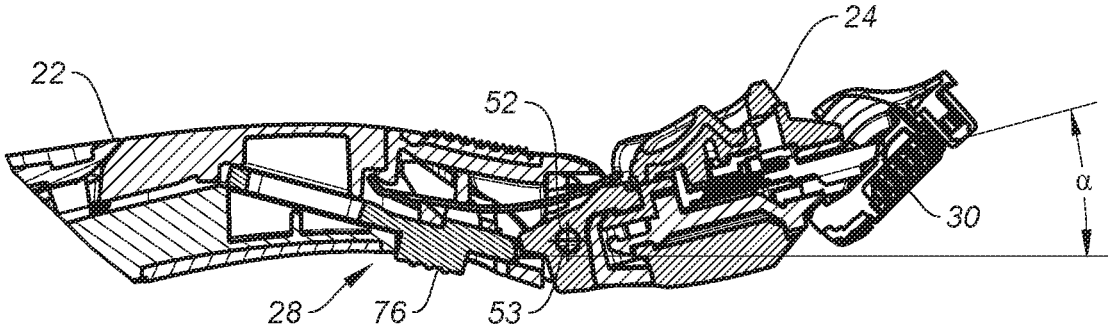
FIG. 14 is a side sectional view of the razor handle embodiment, showing the lock mechanism in an unlocked position and the cartridge mount portion in a second position.
Figure 15:
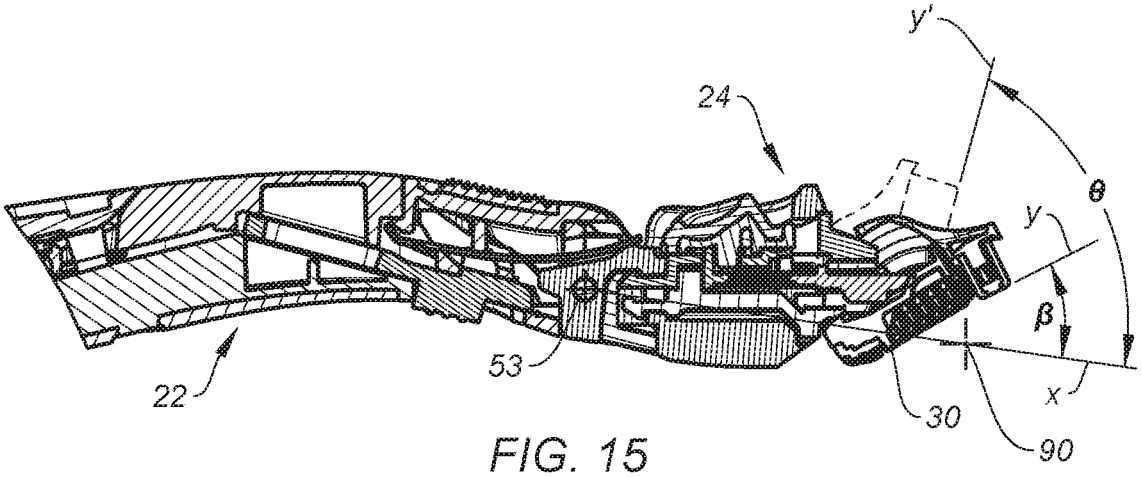
FIG. 15 is a side sectional view of the razor handle embodiment, showing the lock mechanism in an unlocked position and both the cartridge mount portion and razor cartridge in a normal at rest position, as well as the razor cartridge in a rotated position in phantom.

As indicated above the present handle is configured such that the grip portion 22 and the cartridge mount portion 24 are capable of relative pivotal movement up to an angle "α" (e.g., see FIG. 14). FIG. 15 illustrates a line "X" that intersects the cartridge mount portion pivot axis 53 of the pivot axle 52 and the cartridge pivot axis 90, and a line "Y" that is shown to identify the orientation of the razor cartridge 30 when the razor handle 20 and the razor cartridge 30 are at rest. The line "Y", for example, may be disposed in a shave plane of the razor cartridge 30. The line "Y" could be defined alternatively; e.g., a line tangential to a plurality of blade edges within the razor cartridge 30, etc. The included angle between lines X and Y when the razor handle 20 and the cartridge are at rest in their normal positions is "β". As described herein, in some embodiments the razor cartridge 30 is configured to rotate relative the cartridge mount portion 24, for example to an angle "θ" (where line Y is labeled "Y'"). Hence, the razor cartridge 30 may be oriented relative to the line X in the range of angles between "β" and "θ". A non-limiting example of angle "β" is in the range of about thirty to thirty-five degrees (30-35°) and a non-limiting example of angle "θ" is in the range of about forty to forty-five degrees (70-80°). Using these examples, the razor cartridge 30 may be oriented relative to the line X in the range of an angle between about thirty to eighty degrees (30-80°). The ability of the cartridge mount portion 24 to rotate relative to the grip portion 22 by an angle of "α", further increases the rotational range of the shave plane of the razor cartridge 30, because the rotation of the cartridge mount portion 24 relative to the grip portion 22 (i.e., about the cartridge mount portion pivot axis 53), and the rotation of the razor cartridge 30 relative to the cartridge mount portion 24 (i.e., about the cartridge pivot axis 90) are parallel one another.

Now referring to FIGS. 8, 9, and 12-14, the at least one biasing element 26 biases the cartridge mount portion 24 in the at rest position, and allows movement between the normal "at rest" position and the maximum second position. A variety of different biasing elements 26 can be used to bias the cartridge mount portion 24 relative to the grip portion 22, and the at least on biasing element 26 is not therefore limited to any particular embodiment. An example of an acceptable is a leaf type spring 62, a portion of which is held in place (e.g., by a mechanical feature such as tab or a fastener, or by other means) within the grip portion 22. A distal section 64 of the leaf spring 62 is positioned to act on a portion of the cartridge mount portion 24. Hence, the distal section 64 of the leaf spring 62 acts on the cartridge mount portion 24 when the cartridge mount portion 24 is in the at rest position. When a force sufficient to overcome the leaf spring biasing force is applied to the razor cartridge 30 (or the cartridge mount portion 24), the cartridge mount portion 24 will rotate away from the at rest position in the direction toward the maximum second position. When the force applied to the razor cartridge 30 is removed, the leaf spring 62 will cause the cartridge mount portion 24 to rotate back to the at rest position. In a preferred embodiment, the biasing force produced by the biasing element 26 is substantially linear throughout the rotational range of the cartridge mount portion 24. Also in a preferred embodiment, the amount of force applied to the razor cartridge 30 necessary to overcome the biasing force is in the range of about one and one-half to three Newtons (1.5-3.0 N), and most preferably in the range of about two to two and one-half Newtons (2.0-2.5 N). As indicated above, the described leaf spring 62 arrangement is a non-limiting example of a biasing element 26. Alternative biasing elements include coils springs and the like.

Figure 13:
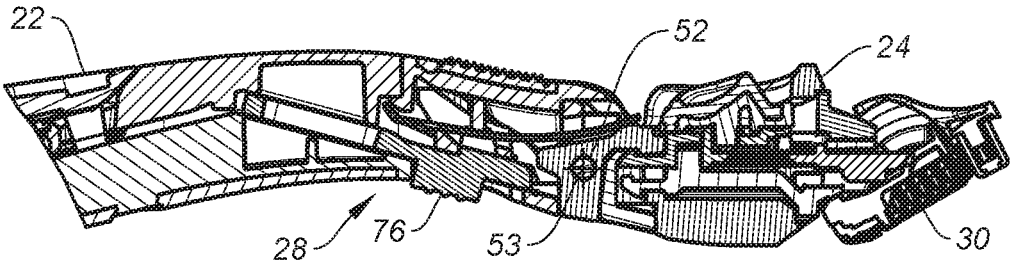
FIG. 13 is a side sectional view of the razor handle embodiment, showing the lock mechanism in an unlocked position and the cartridge mount portion in a normal at rest position.

Now referring to FIGS. 6, 7A-7C, and 12-14, the lock mechanism 28 is a structure configured to be selectively positioned in a locked position (e.g., see FIG. 12) and an unlocked position (e.g., see FIGS. 13 and 14). When the lock mechanism 28 is positioned in the lock position (e.g., see FIG. 12), a portion of the lock mechanism 28 engages the cartridge mount portion 24 and prevents relative pivotal motion between the cartridge mount portion 24 and the grip portion 22. When the lock mechanism 28 is positioned in the unlocked position, the lock mechanism 28 is disengaged with the cartridge mount portion 24 and consequently does not prevent relative pivotal motion between the cartridge mount portion 24 and the grip portion 22; i.e., the cartridge mount portion 24 and the grip portion 22 are free to rotate relative to one another. A variety of different lock mechanisms 28 can be used to prevent relative movement between the cartridge mount portion 24 and the grip portion 22, and the present razor handle 20 is not therefore limited to any particular lock mechanism 28 embodiment. The lock mechanism 28 enables the user to use the present razor handle 20 in two different modes; i.e., a first mode where the cartridge mount portion 24 (and attached razor cartridge 30) can be biased against the surface being shaved, and a second mode wherein the razor handle 20 is a unitary, rigid handle.

For example, a lock mechanism 28 may be mounted within the grip portion 22 of the handle 20, and selectively translatable between the locked position and the unlocked position. Features associated with the lock mechanism 28 and the grip portion 22 maintain the lock mechanism 28 in the locked position and the unlocked position. A specific example of such a lock mechanism 28 can be seen in FIGS. 6, 7A-7C, and 12-14. In this particular embodiment, the lock mechanism 28 includes a body 66 having a first side 68, a second side 70, a first lateral side 72, a second lateral side 74, a lock button 76 extending outwardly from the first side 68, and an engagement end 78 (e.g., see FIG. 6). The lock mechanism 28 body includes an interior cavity 80 (e.g., slot-shaped), a first detent feature 82 aligned with the cavity 80 and extending outwardly from the first lateral side 72, and a second detent feature 84 aligned with the cavity 80 and extending outwardly from the second lateral side 74. A distance "W1" (e.g., see FIG. 7C) extends between the outer surfaces of the first and second detent features 82, 84. Also in this particular embodiment, the bottom panel element 44 of the grip portion 22 includes a pair of detent features 86, 88 that cooperate with the lock mechanism 28. A distance "W2" extends between the outer surfaces of the first and second detent features 86, 88 of the bottom panel element 44, wherein the distance W2 is less than the distance W1. When a user is selectively engaging the lock mechanism 28 (i.e., moving the lock mechanism 28 from the unlocked position to the locked position), the user applies a translation force to the lock button 76 thereby moving the lock mechanism 28 toward the cartridge mount portion 24. As the lock mechanism 28 is translated toward the locked position, the detent features 82, 84 of the lock mechanism 28 contact the detent features 86, 88 of the bottom panel element 44. Further translation causes the detent features 82, 84 of the lock mechanism 28 to elastically deflect inwardly (i.e., the distance "W1" becomes equal to or less than W2) to allow the further translation. Once the detent features 82, 84 of the lock mechanism 28 are past the detent features 86, 88 of the bottom panel element 44, the detent features 82, 84 of the lock mechanism 28 elastically recover and the engagement end is engaged with the cartridge mount portion 24. In this position, the 82, 84, 86, 88 are aligned to interfere with one another. Absent a return translation force being applied to the lock button 76, the features 82, 84, 86, 88 will prevent translation of the lock mechanism 28 away from the cartridge mount portion 24. Hence, the engagement end 78 is maintained engaged with the cartridge mount portion 24.

To selectively return the lock mechanism 28 to the unlocked position, the user translates the lock mechanism 28 in the reverse direction; i.e., the detent features 82, 84 of the lock mechanism 28 are pushed past the detent features 86, 88 of the bottom panel element 44 (elastically deflecting as they pass). Once the detent features 82, 84 of the lock mechanism 28 are past the detent features 86, 88 of the bottom panel element 44, the detent features 82, 84 of the lock mechanism 28 elastically recover. In this position, the detent features 82, 84, 86, 88 are aligned to interfere with one another and will prevent translation of the lock mechanism 28 toward the cartridge mount portion 24. Hence, the engagement end is maintained disengaged with the cartridge mount portion 24.

As indicated above, the present disclosure is not limited to the above-described specific lock mechanism 28 embodiment. For example, the specific embodiment described above includes pairs of detent features for both the lock mechanism 28 and the bottom panel element 44. In alternative embodiments, each of the lock mechanism 28 and the bottom panel element 44 may have fewer or more detent features. Moreover, mechanical features other than the described detent features (e.g., mating male and female features, magnetic features, etc.) may be used. In alternative embodiments, an element other than the lock mechanism 28 may elastically deflect to allow translation (e.g., a portion of the grip portion 22 may elastically deflect), or more than one element may deflect to permit translations. In alternative features, the lock mechanism 28 may be configured to be maintained in more positions than just the locked and unlocked positions; i.e., the cartridge mount portion 24 may be selectively positionable in more than two positions.

The present razor handle 20 may be configured as a disposable unit wherein a razor cartridge 30 is attached to the cartridge mount portion 24 in a manner wherein it is not intended to be replaced, and the entire razor is disposed of once the razor cartridge 30 can no longer provide an acceptable shave. In other embodiments, the present razor handle 20 may be configured to be used with a replaceable razor cartridge 30 that can be removed and replaced once that razor cartridge 30 can no longer provide an acceptable shave.

In some embodiments, the cartridge mount portion 24 may be configured to allow the razor cartridge 30 to pivot about a widthwise extending cartridge pivot axis 90 (e.g., see FIGS. 15 and 16) that is substantially parallel to the blade edge(s) of the razor cartridge 30. The pivotal movement of the razor cartridge 30 about the widthwise cartridge pivot axis 90 allows for some degree of conformance with the skin. In these embodiments, the cartridge pivot axis 90 is substantially parallel to the cartridge mount portion pivot axis 53 of the pivot axle 52 connecting the grip portion 22 and the cartridge mount portion 24 of the present handle 20, and both the cartridge pivot axis 90 and the cartridge mount portion pivot axis 53 are substantially perpendicular to the lengthwise axis 46 of the handle 20. Hence, these embodiments provide the present handle 20 with two pivot axes, one of which can be selectively utilized by placing the lock mechanism 28 in the unlocked position, or not utilized by placing the lock mechanism 28 in the unlocked position.

The embodiments shown in FIGS. 1-5 are configured to utilize a replaceable razor cartridge 30 and a razor cartridge 30 that is pivotable relative to the cartridge mount portion 24 of the handle 20. As can be seen in the exploded view of FIG. 3 (see also FIGS. 8 and 9), the cartridge mount portion 24 includes an attachment mechanism 60 that can be selectively operated to release a razor cartridge 30 and allow an attached razor cartridge 30 to pivot relative to the cartridge mount portion 24. The present disclosure is not limited to any particular mechanism for releasing/attaching a razor cartridge 30 or any particular mechanism for pivotally attaching a razor cartridge 30. U.S. Pat. No. 7,331,107, which is hereby incorporated by reference in its entirety, discloses an example of an acceptable razor cartridge pivotal mounting arrangement that can be used with the present razor handle 20. For example, the present cartridge mount portion 24 may include a cartridge attachment mechanism 60 that includes a pair of arcuately shaped tabs 92A, 92B. The arcuately shaped tabs 92A, 92B are biased outwardly to a normal position. In the normal position, and when the razor cartridge 30 is mounted on the cartridge mount portion 24, each of the tabs 92A, 92B is received within a respective mating feature (e.g., a slot—not shown) disposed in the razor cartridge 30. When the razor cartridge 30 is rotated, the tabs 92A, 92B slide within the slots. A button 94 that is engaged with the attachment mechanism 60 is biased in a normal position, and can be translated to cause the attachment mechanism 60 to move the tabs 92, 92B inwardly to a position where the tabs are not engaged with the slots. One the tabs 92A, 92B are free of the slots, the razor cartridge 30 can be removed. The reverse process is used to attach a new razor cartridge 30. The attachment mechanism further includes a biased cam 96 that acts against a cam surface on the razor cartridge 30. The cam 96 biases the razor cartridge 30 into a normal position and may be displaced from the normal position when sufficient force is applied to the razor cartridge 30 to cause rotation of the razor cartridge 30. As stated above, the above described razor cartridge attachment mechanism 60 is a non-limiting example of an arrangement that can be used to accomplish pivoting of the razor cartridge 30 about a pivot axis, and to permit attachment and release of a razor cartridge 30.

As will be recognized by those of ordinary skill in the pertinent art, numerous modifications and substitutions may be made to the above-described embodiment of the present invention without departing from the scope of the invention as set forth in the appended claims. Accordingly, the preceding portion of this specification is to be taken in an illustrative, as opposed to a limiting sense.

The invention claimed is:

1. A razor handle for mounting a razor cartridge, the handle comprising:

a grip portion extending along a lengthwise extending axis;

a cartridge mount portion, pivotally attached to the grip portion and rotatable about a cartridge mount portion pivot axis between a normal first position and a second position, and which cartridge mount portion pivot axis is parallel to a cartridge pivot axis defined by a razor cartridge attachment mechanism of the cartridge mount portion;

a lock mechanism selectively translatable between a lock position wherein the cartridge mount portion is prevented from rotating relative to the grip portion and at least one unlocked position wherein the cartridge mount portion is free to rotate relative to the grip portion, wherein a lock mechanism body includes one or more features that selectively maintain the lock mechanism in one of the lock position and the unlocked position; and at least one biasing element configured to apply a biasing force against the cartridge mount portion that biases the cartridge mount portion in the normal first position and allows pivotal movement of the cartridge mount portion between the first position and a second position spaced from the normal first position when the lock mechanism is in the unlocked position, and wherein the one or more features is a first detent, and the grip portion includes a least one second detent configured to engage the first detent of the lock mechanism body when the lock mechanism body is moved between the lock position and the unlocked position.

2. The razor handle of claim 1, wherein lock mechanism is mounted within the grip portion.

3. The razor handle of claim 2, wherein the lock mechanism body has an outwardly extending button outwardly extending from the lock mechanism body, which button extends through an exterior surface of the grip portion.

4. The razor handle of claim 1, wherein the lock mechanism body includes an engagement end; and wherein in the lock position the engagement end is engaged with the cartridge mount portion, and in the unlocked position the engagement end is disengaged with the cartridge mount portion.

5. The razor handle of claim 1, wherein the lock mechanism body is elastically deformable to permit elastic movement of the detent.

6. The razor handle of claim 1, wherein the lock mechanism body includes a cavity that extends through the lock mechanism body between a first side of the lock mechanism body and a second side of the lock mechanism body, and the detent is disposed on a lateral side of the lock mechanism body.

7. The razor handle of claim 1, wherein the cartridge mount portion and the grip portion are oriented relative to one another to have a rotational angle $\alpha$ there between, and between the first normal position and the second position the rotational angle $\alpha$ is equal to or less than about twenty degrees.

8. The razor handle of claim 1, wherein the razor cartridge attachment mechanism can be selectively operated to release a razor cartridge and to attach the razor cartridge.

9. The razor handle of claim 1, wherein the at least one biasing element includes a leaf spring mounted in the grip portion, which leaf spring includes a distal end that is engaged with the cartridge mount portion.

10. A razor, comprising:

a razor cartridge having at least one razor blade, which cartridge is pivotable about a cartridge pivot axis; and a handle that includes:

a grip portion extending along a lengthwise extending axis;

a cartridge mount portion, pivotally attached to the grip portion and rotatable about a cartridge mount portion pivot axis between a normal first position and a second position, and which cartridge mount portion pivot axis is substantially parallel to the cartridge pivot axis;

a lock mechanism selectively translatable between a lock position wherein the cartridge mount portion is prevented from rotating relative to the grip portion and at least one unlocked position wherein the cartridge mount portion is free to rotate relative to the grip portion, wherein a lock mechanism body includes one or more features that selectively maintain the lock mechanism in one of the lock position and the unlocked position; and at least one biasing element configured to apply a biasing force against the cartridge mount portion that biases the cartridge mount portion in the normal first position and allows pivotal movement of the cartridge mount portion between the first normal position and a second position spaced from the first position when the lock mechanism is in the unlocked position, and wherein the one or more features is a first detent, and the grip portion includes a least one second detent configured to engage the first detent of the lock mechanism body when the lock mechanism body is moved between the lock position and the unlocked position.

11. The razor of claim 10, wherein lock mechanism is mounted within the grip portion, and the lock mechanism body has an outwardly extending button, which button extends through an exterior surface of the grip portion.

12. The razor of claim 10, wherein the lock mechanism body includes an engagement end; and wherein in the lock position the engagement end is engaged with the cartridge mount portion, and in the unlocked position the engagement end is disengaged with the cartridge mount portion.

13. The razor of claim 10, wherein the cartridge mount portion and the grip portion are oriented relative to one another to have a rotational angle $\alpha$ there between, and between the first normal position and the second position the rotational angle $\alpha$ is equal to or less than about twenty degrees.

14. The razor of claim 10, wherein the cartridge mount portion includes a razor cartridge attachment mechanism that can be selectively operated to release the razor cartridge and to attach the razor cartridge.

15. The razor of claim 10, wherein when the razor cartridge is in an at rest position a line through a shave plane of the razor cartridge forms an angle $\beta$ with a line extending through the cartridge mount portion pivot axis and the cartridge pivot axis, which angle $\beta$ has a value in the range of about 30-35 degrees.

16. The razor of claim 10, wherein the razor cartridge is pivotable about the cartridge axis by an angle in the range of about 40-45 degrees.

17. The razor of claim 10, wherein the at least one biasing element includes a leaf spring mounted in the grip portion, which leaf spring includes a distal end that is engaged with the cartridge mount portion.

* * * * *